US009784546B2

(12) United States Patent
Burdine et al.

(10) Patent No.: US 9,784,546 B2
(45) Date of Patent: Oct. 10, 2017

(54) AREA DENIAL SYSTEM

(71) Applicants: Robert Van Burdine, Ardmore, TN (US); Dorothy Devine Burdine, Ardmore, TN (US)

(72) Inventors: Robert Van Burdine, Ardmore, TN (US); Dorothy Devine Burdine, Ardmore, TN (US)

( * ) Notice: Subject to any disclaimer, the term of this patent is extended or adjusted under 35 U.S.C. 154(b) by 0 days.

(21) Appl. No.: 14/587,171

(22) Filed: Dec. 31, 2014

(65) Prior Publication Data

US 2016/0187114 A1 Jun. 30, 2016

(51) Int. Cl.
*F42B 23/00* (2006.01)

(52) U.S. Cl.
CPC ..... *F42B 23/005* (2013.01)

(58) Field of Classification Search
CPC ..... F42B 23/005; A01M 23/36
USPC ..... 102/401–429
See application file for complete search history.

(56) References Cited

U.S. PATENT DOCUMENTS

| | | | | |
|---|---|---|---|---|
| 765,818 | A * | 7/1904 | Crago | A01M 23/36 124/37 |
| 3,033,113 | A * | 5/1962 | Lowe | F42C 15/42 102/409 |
| 8,689,695 | B2 * | 4/2014 | Burdine | F42B 23/04 102/401 |
| 9,032,805 | B2 * | 5/2015 | Wakeman | G01L 19/10 116/273 |
| 2013/0220160 | A1 * | 8/2013 | Burdine | F42B 6/003 102/439 |

* cited by examiner

*Primary Examiner* — Stephen Johnson
*Assistant Examiner* — Joshua T Semick

(57) ABSTRACT

A propelled lance provides a wounding non-lethal anti-opponent action by piercing an enemy's foot or other contacting body part with a lance penetrator. The lance penetrator lodges in the body and further penetration is optionally impeded by an integrated stop device. The lance penetrator optionally inserts an RFID, other identification, tracking, or other payload into the enemy. The lance penetrator provides anti-personnel, anti-vehicle and anti-robot action.

2 Claims, 12 Drawing Sheets

AREA DENIAL SYSTEM

FIELD OF THE INVENTION

The present invention relates to defense means, particularly to the field of non-lethal area denial devices, and to non-lethal devices for injuring, disabling, RFID tagging or otherwise marking enemy personnel, vehicles and robots. The present invention relates to devices such as landmines and other area denial devices that, after deployment, are armed or arm themselves through the action of an integrated component or function, and later are disarmed or disarm themselves through a process.

SUMMARY OF THE INVENTION

Explosive anti-personnel landmines cause thousands of deaths and severe, life limiting injuries amongst the enemy and civilians every year. Every year anti-personnel landmines kill or maim over 20,000 civilians.

Because of widespread international concern about the high number of civilian injuries and deaths from these mines, there is general agreement among many Governments that it is necessary to restrict and eliminate these weapons. This has resulted in an international treaty known as the Ottawa Convention to ban explosive Anti-Personnel Landmines.

The United States is not a signatory to this treaty. Military forces see the continuing need to deny enemy access to areas, or to delay access until friendly troops can occupy and mount defenses. The United States maintains that United States anti-personnel mines are not the cause of civilian casualties since the anti-personnel mines in United States mine systems self-destruct during or shortly after combat.

The need for anti-personnel landmines will never go away as it is highly desirable to selectively deny an enemy access to an area. It is also highly desirable to deny access to approaches around camps and fortifications, both on a long and short-term basis. With an explosive anti-personnel landmine, the possibility of civilian injury and death is very high. The possibility of accidental injury or death to friendly forces is also high during deployment and recovery of the landmine.

The most common use of mines in conflicts is to protect economic and social targets such as bridges, dams, oil, gas and water pipelines, airports and railroad stations from attack or sabotage by the enemy. The present invention meets this need, and as it is non-lethal and non-maiming in nature is suitable for long term and wide deployment as an area denial or perimeter defense device.

The lance penetrator of the current invention is anti-personnel in nature, but does not produce a large explosion to incapacitate or kill the enemy personnel. The lance penetrator effects a deterrent action by driving a lance into the enemy personnel where, with certain preferred embodiments herein described, achieves by a variety of methods the incapacitation and deterrent of the enemy personnel to continue the battle. The present invention is both incapacitating and nonlethal in its nature. The enemy personnel is placed in immediate need of specialized medical attention, thereby encouraging the enemy personnel to leave the battlefield or surrender, all without the endangerment of life or property.

The present invention provides a landmine replacement that is non-lethal yet poses a serious threat of pain and injury providing a strong deterrent to enemy personnel entering the area. The present invention causes a painful and temporally disabling injury, and provides options for tagging, identifying and tracking enemy personnel. The present invention provides for the use of electrical, chemical, mechanical and biological means to further deter the enemy personnel as desired.

The present invention provides a lance penetrator that inflicts a non-lethal injury to enemy personnel by means of a lance that will pierce the body at the point of contact. The lance penetrator does not accomplish its deterrent action by exploding, but by driving a lance into the enemy, preferably the enemy's foot. The lance will cause severe pain at the point of entry, but will not penetrate far enough to be life threatening. Further, the lance is preferably equipped with an identification device, such as a Radio Frequency Identification Device known generally as an RFID chip, that is inserted into the body of the enemy personnel and remains there even if the enemy personnel pulls the lance out. Other identification devices include those comprised of metal, magnetic material, radioactive material, biological agents, chemical or chemicals, drugs, paper, plastic, ceramic, glass, wood, organic materials or combinations thereof.

By equipping the lance of the present invention with an embeddable RFID chip, the lance may be easily cataloged and identified if removal from the field becomes necessary. The RFID chip that is imbedded in an enemy personnel may be matched with the RFID of the delivering lance providing an exact location of the enemy personnel at the time of the lance activation. An RFID chip may be momentarily powered by the lance initiation recording the time of initiation from a provided but remote radio frequency (RF) transmitter or from commercial or other sources. A single RFID in the lance may be used for all purposes. The lance penetrator and lance tube are equipped with identification markings for record keeping, identification and control.

The lance is shaped and surfaced to readily penetrate and enter the body. It resists attempts to remove it by simply pulling or tugging. The lance is selectively ribbed or roughened, barbed, wired, or may have a shaped surface that requires expansion of the wound to facilitate removal. The lance may be further equipped to be separable in tension allowing a portion of the lance to separate during a removal attempt leaving the remaining portion of the lance imbedded in the insurgent.

The lance shape is selectable, and shapes such as a drywall screw that are difficult to remove are preferred. Attempts to remove the lance are complicated such as by making the shape a left hand screw. In this manner an uninformed person attempting to remove the screw shaped lance using the right hand turning action, will simply drive the lance deeper into the foot of the enemy personnel. Alternating screw directions may exist on the same lance providing maximum damage and discomfort if the lance moves. Lances that are thus shaped will discourage casual attempts at removal. Knowledge that specialized tools for removal exist will encourage the enemy personnel to quickly surrender and seek medical attention.

The lance penetrator is low noise in its operation as the lance is directly impacting and penetrating the foot or sole of the boot, and the expanding gas noise is muffled by the enemy being directly on top of the lance.

The area denial device including the tube and lance penetrator is preferred to be constructed of a wide range of materials including non-magnetic materials such as polycarbonates. An area denial device made entirely of a polycarbonate is not detectable by magnetic means.

While the method of this invention is herein shown and described with reference to specific embodiments, it will be understood by those skilled in the art that many deviations, derivations and variations in form and specific details may be made therein without departing from the scope of the invention which is limited only by the claims annexed hereto.

DISCUSSION OF THE PRIOR ART

A landmine is an explosive device concealed under or on the ground intended to damage a target by means of a blast and/or fragment impact. Antipersonnel landmines are explosive devices detonated by the presence, proximity or contact of a person. Such area denial weapons are used to prevent an adversary from occupying or traversing an area of land. Placed under or on the ground, these mines can lie dormant for years until a person or animal triggers their detonating mechanism.

Every month over 2,000 people are killed or maimed by mine explosions. Most of the casualties are civilians killed or injured after hostilities have ended. It is reported that surgical care and the fitting of an orthopedic appliance cost about $3,000 per amputee in developing countries. This means a total expenditure of over $750 million for the 250,000 amputees registered worldwide by the United Nations.

The present invention is an area denial, antipersonnel and antivehicle/antirobot device that is not an explosive landmine. It does not injure or maim by explosive blast. It operates by inflicting an incapacitating wound on the encountering personnel immediately removing them from the combatant or terrorist activity. Personnel may fully recover from an encounter with the present invention given prompt medical attention. The present invention does not maim or kill as a preferred antipersonnel action.

Historically, unexploded landmines have posed a serious threat to military and civilian personnel. Once located, the generally employed method of dealing with these dangerous devices is to detonate them where they lie or transport them to a safe location for detonation or burning. Devices too dangerous to handle or transport, such as armed mines, may be neutralized by overcrossing the area with rollers or chains initiating the mines. This is an expensive and time-consuming procedure, and one that normally requires re-working the area with heavier follow-up rollers to destroy deeper laid devices and to confirm the effectiveness of the neutralization process prior to returning the land to general use.

The present invention is selectable for both initiation pressure and the angle of the applied pressure. It is also readily constructed of non-magnetic materials. In this manner current techniques for mine detection, removal and neutralization are rendered ineffective.

To facilitate the identification and neutralization of unexploded ordnance a number of methods have evolved. U.S. Pat. No. 4,711,179 embodies a landmine that after deployment in an armed state will, after a predetermined length of time, disarm itself and eject a marker to identify the location of the disarmed mine. The disarming mechanism and the spotting charge used in the ejecting stage require numerous electronic and mechanical components, including a timer, battery, and motor. These items increase the expense and complexity of the munition. Additionally, the highly visible marker is more likely to be discovered by enemy forces than not. The present invention is optionally disarmed by deterioration of its components (such as an o-ring) or self initiation through contained chemical reaction or electronic means either self contained or initiated by remote or local means such as radio control or the sensing of a magnetic or electromagnetic field. The present invention does not contain significant amounts of explosive or materials that can be reutilized by an opponent.

U.S. Pat. No. 6,629,499 describes a mechanical timer device that depends upon ambient temperature fluctuations to count down and is used to render safe a mine or other ordnance device after a certain period of time. Repetitive temperature flux is questionable, or at least limits the environment in which the mine timer can operate, and the large amount of metal makes the mine easy to find by standard techniques.

U.S. Pat. No. 3,447,461 reveals an antipersonnel mine that is self-neutralizing through the utilization of an internal water reservoir or through the admission of atmospheric moisture to the interior of the device via numerous apertures. The dispersion of the moisture within the confines of the mine causes a suitable medium to become engorged and enlarged, thus initiating a series of events culminating in the movement of an obstruction between the firing pin and the detonator. Reliance on environmental conditions is unpredictable and unreliable.

A deactivation means is incorporated into the design offered in U.S. Pat. No. 3,464,354. The disarming mechanism relies upon the device's loss of pressurization over time. The time interval for the deactivation is not known. Deactivation relies upon the assumption that a permanent air pressure seal is unachievable. The premise is that once deployed, the device's pressurization will last no longer than a few years. The pressurization is also the force used to drive the firing pin into the detonator. Consequently, once pressure is lost, there no longer exists the required energy to propel the firing pin; and the device becomes deactivated. This device leaves behind a significant amount of explosive material whereas the present invention does not contain significant explosive or other readily reusable materials.

U.S. Pat. No. 6,014,932 describes a mine that can be remotely armed after placement. The patent describes a system for remotely arming a landmine via satellite or an airborne vehicle, and a corresponding method. This added expense for communication, command and control will significantly increase the cost of the munitions.

U.S. Pat. No. 3,667,387 discloses a self-destructing landmine. The self-destructing process is initiated by the rupturing of internally contained glass vials containing a solvent. This solvent reacts with a nitrocellulose outer film. The eventual dissolution of the nitrocellulose film causes the confined phosphorus to become exposed to the atmosphere, thus initiating the violent destruction of the mine. This landmine is so dangerous that it must be stored and transported submerged in water. Otherwise, should one or more of the internal glass vials rupture, the ensuing atmospheric exposure of the phosphorus will have catastrophic results. Logistically it is unrealistic to transport large quantities of this device in a hostile environment while maintaining them submerged in water.

Another method of eliminating the dangers of unexploded ordnance is described in U.S. Pat. No. 4,493,239. The patent discloses a process of enhanced oxidation of buried aluminum and ferrous ordnance through the establishment of a continuous flow of direct current electricity through the soil medium. This continuous flow of electricity may be enhanced through the constant saturation of the ground up to a depth of three feet with a saline solution to enhance the oxidation process. Completion of the process may take up to ten years. This prolonged process is impractical for use in most locations and prohibitively expensive where it could be employed. The present invention does not contain an explosive and is very small having little effect on the land once it is abandoned. It causes immediate injury that the affected person will have to recover from but with medical attention will not cause life altering injury or death.

Electronic munitions that self-destruct at the end of their battery life are also known. Devices of this type are usually expensive and are readily detected due to their electronic emissions and battery mass.

The need for an effective and self arming/disarming munition is exemplified by the proliferation of attempts to produce self-neutralizing anti-personnel ordnance. Under the present invention, a simpler, more efficient, reliable, and less costly method of achieving this end is disclosed.

It has been a matter of considerable effort to devise an effective landmine that at the same time can be rendered harmless. More recent work has centered on nonlethal mines that repel or mark an enemy personnel.

In 1999, the Ottawa treaty went into force to prohibit the use, stockpiling, production and transfer of explosive anti-personnel landmines. The U.S. did not sign this treaty as it desires to use anti-personnel landmines in military operations. It is widely understood that the U.S. wants to be able to be compliant with the Ottawa treaty. The dilemma is how to preserve the effectiveness of minefields while eliminating the explosive anti-personnel landmine. To achieve this desired outcome many technologies have been proposed.

U.S. Pat. No. 6,640,721 describes a non-lethal airbag munition that can be used alone or in combination with anti-tank landmines to prevent target pedestrians and vehicles from entering a specific area or following a particular route for a period of time is disclosed. The munition can inflict severe ankle and foot injuries to target pedestrians but discriminates based upon the weight of the target. This method may or may not remove an insurgent from the battle. This method produces injury that may or may not incapacitate the subject personnel. In addition, injury levels may include ankle or knee damage that may be a life altering injury. The present invention initiates a simple puncture wound that, even if through a joint or bone is recoverable given prompt medical attention.

U.S. Pat. No. 5,936,183 describes a non-lethal alternative to the anti-personnel landmine. The TASER® alternative uses electronic stun capability in combination with a landmine housing and deployment system. The device can cover a radius of 15 feet (30 feet possible) and can be triggered by various sensors. Although the TASER® non-lethal area denial device would cause no deaths or injuries if accidentally triggered by friendly forces, it can also be permanently disabled when no longer needed by remotely using a secure code to shut down the TASER® system. When triggered, the device launches darts in multiple directions at 10 or 20 degree intervals in a direction generally facing the enemy. The darts temporarily incapacitate any persons within an inch of the darts by causing uncontrollable spasms of the near surface motor control muscles causing temporary loss of the subject's motor control functions. The subject will fall and is temporarily and completely incapacitated. The device will take down persons wearing soft body armor because high voltage electricity readily arcs through the fabric weaving holes. A timing circuit keeps the subjects incapacitated until they can be taken into custody by nearby troops. After the very low power signal is turned off, the subject will recover within minutes. The TASER® device produces no collateral damage and poses no lethal threat to friendly forces even if accidentally triggered. The TASER® does nor produce an injury that would remove an insurgent from the battlefield. While the experience may be undesirable, the insurgent will make a rapid recovery and return to the fight within minutes of the event. The device may be remotely shut down permanently via an encrypted security code.

The present invention may also be remotely shut down permanently or temporarily via an encrypted security code. The present invention also produces no collateral damage and poses no lethal threat to friendly forces even if accidentally triggered. The present invention has the advantage of producing painful and temporarily incapacitating injury causing the enemy personnel to be removed from the battle. The affected personnel will require specialized and immediate medical attention and will be unfit for combat for an extended period of time. Knowledge that the lance of the present invention is specialized in some manner such as incorporating an RFID chip that requires specialized medical attention will give cause for affected enemy personnel to surrender themselves to the proper authorities providing the opportunity for intelligence gathering.

U.S. Pat. No. 7,458,321 describes a non-lethal anti-personnel landmine comprising a sealed container having a first chemical reactant contained therein, and a second container having a second chemical reactant contained therein, the container being positioned within the mine to assure that a stepping action on the mine will result in the opening of the container and the release of the contents thereof into contact with the second chemical reactant, whereby the contact results in a fast chemical reaction non-lethal to the person stepping on the mine. This chemical reaction will get hot, smoke, make a noise, emit light, release an irritant or release a dye. These actions may or may not cause the enemy personnel enough of an injury to require removal from the battlefield. The present invention will incapacitate the enemy personnel in a nonlethal manner, and will immediately necessitate the enemy personnel's removal from the battlefield to seek medical attention.

U.S. Pat. No. 7,137,340 describes the Mixed Mine Alternative (MMA) System. This system is designed for use in mechanized warfare. The MMA System has three components, MMA smart Antitank mines, MMA Antihandling Sensors linked to the MMA smart Antitank mines, and MMA Remote Control Units (RCU). The MMA smart Antitank (AT) mines contain a primary sensor system hardened against countermeasures and a kill mechanism similar to existing scatterable AT mines. The MMA AT mine is capable of transmit and receive communications with a Remote Control Unit and with the MMA Antihandling Sensors (AH). The communications capabilities and processors in the MMA AT and the MMA AH allow the system to establish MMA AT to MMA AH links after the mines have been scattered. MMA AT will be linked to MMA AH that are within their lethal radius. The MMA AT mine processors allow the mine primary antitank sensor to be on or off. The mine may receive and act on detonate instructions from the primary antitank sensor, from the antihandling sensors, or from the MMA RCU. If in an off status the MMA AT mine may relay the detonate signal received from an MMA AH sensor to the RCU. The RCU includes a computer that maintains status information on the mines. Receipt of a relayed AH sensor detonate signal provides situational awareness information that the RCU brings to the user's attention on the screen and with an audible and/or visual signal. Essentially this system uses sensors that cause the antitank landmine to explode as a result of sensors detecting enemy personnel. This may not satisfy the requirements of the Ottawa Treaty. The present invention directly substitutes for explosive anti-personnel mines that protect anti tank landmines, wherein an enemy personnel stepping on the lance will initiate the anti-personnel penetrator and sustain a direct and serious injury that will incapacitate the personnel and require the personnel to be removed from the battlefield to seek immediate medical attention.

U.S. Pat. No. 6,014,932 describes a mine that remotely arms after placement. The patent describes a system for remotely arming a landmine via satellite or an airborne vehicle, and a corresponding method. This added expense for communication, command and control will significantly increase the cost of the munitions. The hazards associated with the present invention are minimal, and significant injury can be avoided during transport, placement and recovery with minimal training and adherence to procedure.

The proliferation of attempts to produce an effective and safe anti-personnel landmine replacement clearly displays the need. The present invention discloses a simpler, more efficient, reliable, and less costly method to achieve this end.

BRIEF DESCRIPTION OF THE DRAWINGS

The invention will now be described by way of example only, with reference to the accompanying drawings in which.

DETAILED DESCRIPTION OF THE PREFERRED EMBODIMENTS

Figure 1:
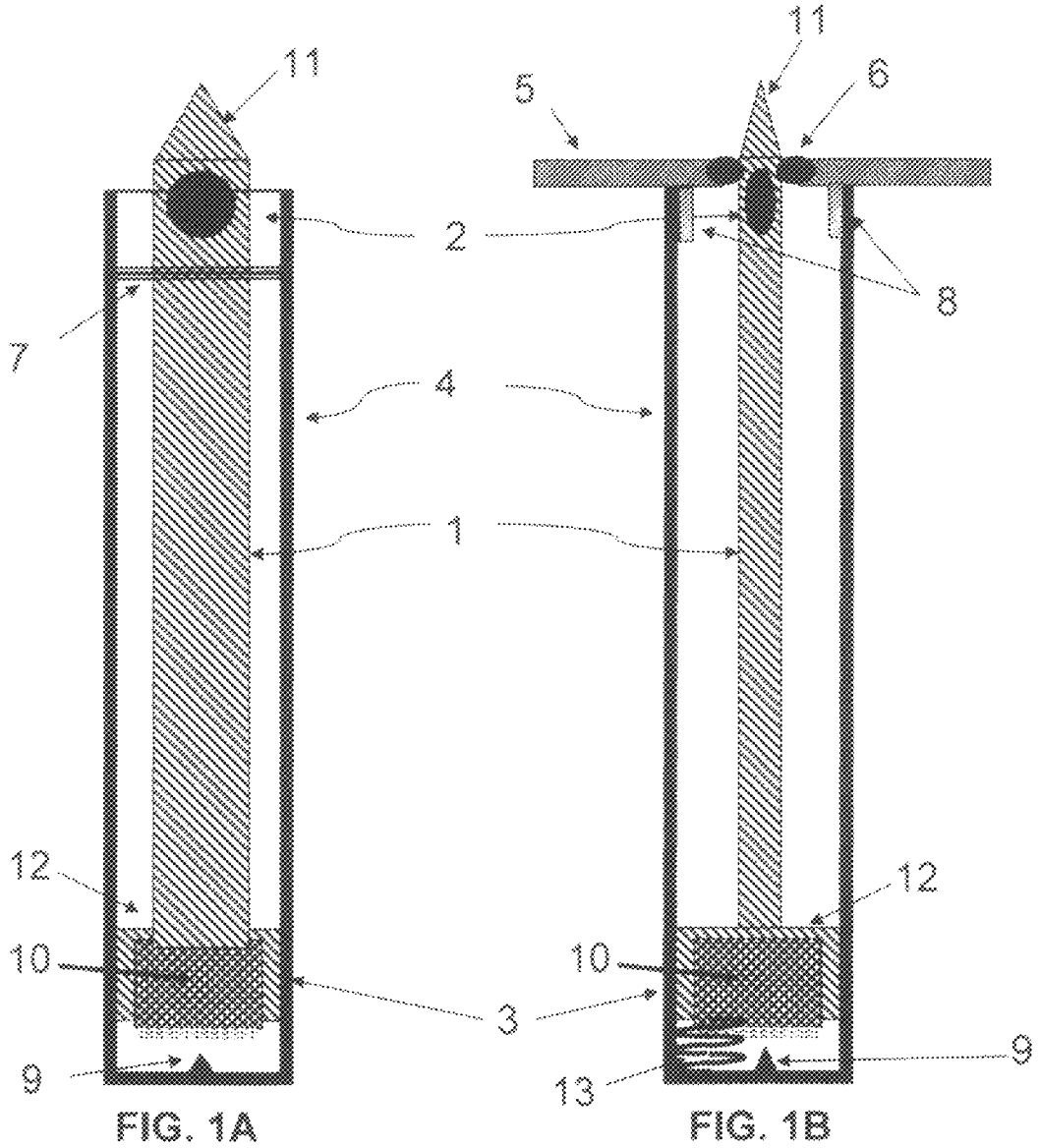
FIG. 1 is a cross-sectional view of the present invention showing the lance with an integrated payload such as an RFID in an open tube, and further a tube sealed against the elements by stop plate, crush washer, washer seal and lance, also with an RFID.

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

The present invention provides a lance penetrator that inflicts a non-lethal injury to enemy personnel by means of a lance that will pierce the body at the point of contact. The terms lance penetrator and area denial device are herein used interchangeable and differ only in reference to the device and the actionability of the device. The lance penetrator does not accomplish its deterrent action by exploding, but by driving a lance into the enemy, preferably the enemy's foot. The lance will cause severe pain at the point of entry, but will not penetrate far enough to be life threatening. Further, the lance is preferably equipped with an identification device, such as a Radio Frequency Identification Device known generally as an RFID chip, that is inserted into the body of the enemy personnel and remains there even if the enemy personnel pulls the lance out.

Other identification devices include those comprised of metal, magnetic material, radioactive material, biological agents, chemical or chemicals, drugs, paper, plastic, ceramic, glass, wood, organic materials or combinations thereof.

By equipping the lance of the present invention with an embeddable RFID chip, the lance may be easily cataloged and identified if removal from the field becomes necessary. The RFID chip that is imbedded in an enemy personnel may be matched with the RFID of the delivering lance providing an exact location of the enemy personnel at the time of the lance activation. An RFID chip may be momentarily powered by the lance initiation recording the time of initiation from a provided but remote RF transmitter or from commercial or other sources. A single RFID in the lance may be used for all purposes.

The present invention acts by a lance driving into an overlaying structure such as a foot or boot. As it acts by concentration of the penetrating force the present invention is effective against blast protected combat boots and other measurers typically employed as protection against conventional land mines.

The present invention is preferred to be pyrotechnically powered. It is further preferred that the propulsive power be supplied by Carbon Dioxide or other compressed gas, or spring in place of a propellant as best suited to the application.

It is a preferred embodiment that the lance and lance tube be provided with unique identification such as a serial number matching the lance and lance tube. The lance penetrator and lance tube are equipped with identification markings for record keeping, identification and control.

It is an object of the present invention to provide a device that operates independently and requires no battery and no additional intrusion detection sensors. It is a further object of the present invention to provide an anti-personnel lance penetrator that does not cause injury by explosive shock.

The lance is shaped and surfaced to readily penetrate and enter the body. It resists attempts to remove it by simply pulling or tugging. The lance is selectively ribbed or roughened, or barbed, or may have a shaped surface that requires expansion of the wound to facilitate removal. The lance may be further equipped to be separable in tension allowing a portion of the lance to separate during a removal attempt leaving the remaining portion of the lance imbedded in the insurgent. The lance shape is selectable, and shapes such as a drywall screw that are difficult to remove are preferred. Attempts to remove the lance are readily complicated such as by making the shape a left hand screw. In this manner an uninformed person attempting to remove the screw shaped lance using the right hand turning action, will simply drive the lance deeper into the foot of the enemy personnel. Alternating screw directions may exist on the same lance providing maximum damage and discomfort if the lance moves. Lances that are thus shaped will discourage casual attempts at removal. Knowledge that specialized tools and techniques for removal exist will encourage the enemy personnel to quickly surrender and seek medical attention.

The lance penetrator is low noise in its operation as the lance is directly impacting and penetrating the foot or sole of the boot or shoe, and the expanding gas noise is muffled by the insurgent being directly on top of the lance penetrator.

The lance is preferred to be constructed of a wide range of materials including non-magnetic materials such as polycarbonates. A lance made entirely of a polycarbonate is not detectable by magnetic means It is a preferred embodiment that the lance penetrator be equipped with a remote and local command control and/or signal capability such as a transponder for the detection of the location of the lance penetrator and control of the fire/no-fire state on the lance mine. Radio, sound, sonic, magnetic, electromagnetic and chemical control methods are preferred. For example a lance penetrator is enabled or disabled by application of a chemical such as an acid spray changing the armed or disarmed state of the mine. Another example is the detection of a magnetic field or the reception of an audio signal resulting in a change of the fire/no-fire condition of the lance mine.

It is a preferred embodiment that the location of the lance penetrator be revealed on receipt of a control signal by action of an optical signal such as a Light Emitting Diode, an audio or sonic signal such as a sound generator or piezoelectric device, a chemical, explosive, or sound device, or a mechanical device such as a vibrator.

It is a preferred embodiment that the location of the lance penetrator be revealed by a mechanical flag, smoke, physical signal, chemical or mechanical, or combination thereof, upon receipt of a control signal.

It is a preferred embodiment that the location of the lance penetrator be revealed, in combination with simultaneous disarmament, on receipt of a control signal by the action of initiating the lance penetrator firing the lance harmlessly into the air or preferably into an overlaying lance capture device.

The present invention is preferred to be equipped such that it can be armed or disarmed, or otherwise controlled by earth born signals. It is further preferred these signals be unidirectional or bidirectional facilitating control and status knowledge to and from the mine.

It is a preferred embodiment that the location of the lance penetrator be revealed upon receipt of a signal, and that the no-fire and/or location revealing initiation signal be limited in its range providing safe access to the lance penetrator or combination of lance mines such as a lance penetrator field after deployment or lance mines during deployment. In this manner the lance penetrator or field of mines may be safely traversed when needed without reducing or impeding the deterrent effectiveness of the present invention.

The present invention is preferred to signal its presence in the form of a piezoelectric transducer, sound, vibration, led, rf signal, chirp, beep, flash to signal its presence whenever armed, disarmed or polled to reveal location. An indication of status such as armed or disarmed being indicated in upon polling is a preferred embodiment of the present invention.

It is a preferred embodiment of the present invention that the lance provides means for passing an electrical current through the penetrated body part, preferably the foot, causing muscle contractions and further incapacitating the enemy. The lance further comprises a battery that passes an electrical current through the muscle tissue surrounding the lance. The muscles contract inhibiting normal movement of the foot. The electrical current is preferred pulsed at a rate greater than 40 pulses per second. In this manner, the muscle has no time to relax between stimuli and the muscle movements fuse into a contraction known as complete tetanus. A muscle in complete tetanus produces the maximum tension the muscle can produce locking the foot into a fixed position. It is a preferred embodiment of the present invention that a continuous or pulsed direct current force the affected muscles into a state of tetanus.

The lance penetrator is preferred to be equipped with a hinged stop plate that, when in the side position, facilitates rotation and aerodynamic stability to the lance penetrator when deployed by air. When the lance penetrator drives into the ground the hinged stop plate rotates into the deployed position stopping further ground penetration and assuming the proper ground surface orientation for the operation of the lance penetrator.

The lance is optionally provided with an adhesive surface such that upon entry it rapidly 'glues' itself in place, forming a bond with the flesh of the enemy personnel and denying easy removal. For example, a fast acting cyanoacrylate coating on the lance causes the lance to seal itself into the wound eliminating the possibility of blood loss and reducing the possibility of removing the lance without medical attention. Any inserted RFID chip may be so equipped to prevent non-professional removal.

The need for munitions such as mines and other devices placed or buried upon land to be safely placed and then rendered safe after a certain period of time is of great importance to the military. After military missions or actions have been completed, it is often important to neutralize or deactivate such mines in order to ensure that civilian personnel or friendly military personnel are not harmed by munitions that have not been activated by enemy forces. Because it is inherently unsafe to attempt to neutralize or deactivate such munitions, a great deal of effort has been put towards munitions that self-destruct or deactivate after a certain period of time has elapsed. There are problems associated, however, with placing a standard timer and actuator system within the mines, and any standard timer would require power to operate. This could be potentially unsafe, subject to failure and would allow such mines to be more easily detected. Therefore, the development of a simple interval timer and actuator system requiring no external power is necessary to accomplish this goal.

The present invention provides means for deployment in a safe or disarmed condition, and after deployment convert to an armed state through interaction with the environment. For example, the present invention is deployed in a wetted state such as by water, and upon drying converts to an armed condition. It is a further object of the present invention that the munition converts itself to a safe or disarmed condition later through interaction with the environment. The present invention is a propellant driven lance that can incapacitate an insurgent as effectively as an anti-personnel landmine without inflicting death or life limiting injury.

A propellant powered lance provides a non-lethal anti-insurgent action on activation by piercing an enemy insurgent's foot with a lance. The lance may be equipped to insert an identifiable device or other payload into the insurgent's foot. The spike may be equipped for anti-vehicle and anti-robot action.

The lance mounts in a propellant pressurizeable tube and is equipped to fire when stepped on. The propellant pressurizes the tube and propels the lance into the foot with enough force to overcome a shoe or boot sole, and enough force to overcome boot armor as desired.

The lance is intended to stop in the boot or shoe sole or the bottom of a bare foot. When the lance penetrator is equipped for higher penetrating force, such as might be used against heavily armored boots, the lance penetrator tube is further equipped with a stop plate that is captured on the propellant chamber shoulder of the lance and carried forward to increase the load distribution thereby stopping the lance at the proper position, even in a bare foot. It is an embodiment that the lance can penetrate heavily armored boots and still stop in the correct position limiting injury to a barefoot civilian.

When the lance stops in a boot sole it effectively 'nails' the boot to the foot. The penetration of the foot by the lance causes immediate incapacitation of the enemy and limits their ability to walk or function. The lance may also be tethered holding the insurgent in place using chain, wire, rope, fiber, cable or other connecting medium to connect the lance to the buried lance penetrator tube or other secured means. The puncture wound produced by the lance may be selected such that blood loss is restricted.

With medical care, the lance is extractable and the enemy will have been removed from the battle in an effective manner without sustaining life limiting injury or death. In a similar manner civilians that step on and initiate the present invention will experience incapacitation but will not sustain life-limiting injury.

The force required to fire the lance penetrator can be predetermined such that the weight of the anticipated target must be achieved before the lance penetrator will fire. It is an embodiment of the present invention that the force necessary to trigger the lance penetrator can be set at the time of manufacture. It is a further embodiment of the present invention that the force necessary to trigger the lance penetrator can be set at the time of deployment. In this manner, a lance penetrator targeted for an adult insurgent would not fire when stepped on by a small child, and a lance penetrator intended for a heavier vehicle or robot would not fire when stepped on by an insurgent.

It is a preferred embodiment of the present invention that the force applied to initiate the lance action be selectable within a range, and that an over or under application of force return the lance penetrator to an armed and ready condition. For example, if too little force is applied the lance penetrator will not initiate and will return to an armed condition. If too much force is applied, the lance penetrator will return to an armed and ready condition. If enough force is applied to fire the lance, the present invention will initiate and fire immediately upon the easing of the pressure. An enemy soldier walking behind a tank may think themselves safe when in reality the present invention is overloaded by the tank tread and does not fire, and immediately returns to an armed and ready state firing as soon as the insurgent steps on the lance penetrator and begins to raise their foot.

Existing mine fuses such as that employed in the M608 double-impulse fuse that will not detonate the mine when the first tank drives over it: instead, it simply arms itself so that the mine detonates when the second vehicle following in the tracks of the first tank drives over it—an event which might occur seconds, hours or even weeks later. The present invention is configurable to not operate at any time when over pressed such as by a tank and to remain operable at all other times. Enemy personnel walking in the tank tracks to avoid mines (supposedly exploded by the tank) are then incapacitated by the present invention when stepped on.

With the present invention area denial devices can be deployed and distributed while in a condition that prevents their initiation. This safe condition is temporary and will move to an armed condition in a predetermined or controlled time. The area denial device is then sensitive and may be easily initiated in a manner inherent to its design. If so configured after a predetermined or controlled time the area denial device will revert to a safe condition.

If a tire, such as a truck or automobile tire, runs over and initiates the lance penetrator, the fired lance will penetrate the tire much as a common nail and will remain in the tire. If the lance is RFID equipped the tire can be tracked and located. Alternatively, the lance can be equipped with means to allow the air to escape from the tire disabling the vehicle.

Anti-robot mines have not been disclosed as it is assumed an explosive mine will destroy or disable a robot. Robots can be designed to survive external explosions and the skin of a robot can deflect Electro Magnetic Pulses (EMP) around its sensitive electronics. The present invention penetrates the robot skin and can optionally explode producing high pressure inside the robot; can inject corrosives, acids, or adhesives inside the robot; can produce an overvoltage pulse or an EMP inside the robot; or can do all three. The present invention can lodge the lance into the robot's skin and tether the robot in place using chain, wire, rope, fiber, cable or other connecting medium to connect the lance to the buried lance penetrator or other secured means.

The present invention is preferred to be chemically, mechanically, or electrically initiated. For example, a common primary explosive initiator such as ASA compound (formed from lead azide, lead styphnate and aluminum) may be pressed into place with the propellant charge and initiated by mechanically pressing the spike. Friction generated by sliding or heat generated by electrical contact are also preferred methods of initiation. The resulting high-pressure gas propels the spike into the insurgent at a high velocity. Well known and common detonators such as lead azide, Pb(N3)2, silver azide (AgN3) and mercury fulminate [Hg (ONC)2] are utilized in the present invention.

Electrical detonators including instantaneous electrical detonators (LED), short period delay detonators (SPD) and long period delay detonators (LPD) may be utilized in the present invention. SPDs are typically measured in milliseconds and LPDs in seconds.

It is an embodiment of the present invention to use materials reactive with air. Air reactive chemicals react in contact with environmental air containing argon, nitrogen or oxygen. Air reactive chemicals that are spontaneously combustible with oxygen are pyrophoric materials. Examples of air reactives are the alkali metals including lithium, sodium, potassium, rubidium, cesium and francium. The alkali metals form ionic solid oxides of composition M2O when they react with air. Sodium also forms the peroxide Na2O2 as the main product, and potassium forms the superoxide KO2, as the principal product.

The alkali metals and their compounds also react with atmospheric water vapor and liquid water. In contact with water they react with it to produce hydrogen and alkali hydroxides such as 2M(solid)+2H2O(vapor)>>2M(aqueous)+2OH(aqueous)+H2(gas). Alkali metal hydroxides are white ionic crystalline solids of formula MOH, and are soluble in water.

Finely divided metal dusts of nickel, zinc and titanium, and dendritic forms of these metals are useful as reactive materials and are preferred materials in the present invention. They; along with the hydrides such as barium hydrides, diborane, diisobutyl and aluminum hydrides; will react with oxygen in air and atmospheric moisture to form unstable bonds and structures. Air reactive materials also include the oxidizable metals in general, organic and inorganic materials, and materials that sublimate in air such as naphthalene and organometallic compounds such as nickelocene.

It is an embodiment of the present invention to use materials reactive with water, either as vapor, humidity, steam, condensate or liquid. Water reactive chemicals are chemicals which react in contact with environmental water. Water reactive materials react when in contact with water, wet surfaces, or even the moisture in the air. Examples and embodiments of the present invention include the alkali metals, anhydrides (such as acetic anhydrides), carbides (such as calcium carbide), halides (such as acetyl chloride, titanium chloride, stannous chloride and other salts), hydrides (such as sodium hydride), organometallics (such as tetramethyl aluminum and nickel carbonyl), oxides (such as sodium and calcium oxides), peroxides (such as sodium and barium peroxide), phosphides (such as aluminum, calcium and copper phosphide) and others such as chlorosulfonic acid and aluminum tribromide. Reactive materials with water also include all sugars and other water soluble organics, water soluble inorganics, and hygroscopic salts. Metals such as iron and zinc react with water and transition from structural metals to nonstructural oxides. All of these materials, when used as a reactive system or a thin film, can be accurately and reliably predicted to fail at a given interval after environmental exposure.

Peroxides, and materials that can form peroxides upon exposure to the environment, are useful when combined with otherwise stable materials as interval timers. Examples include the ethers such as isopropyl ether, ethyl ether and diethyl ether. It is an embodiment of the present invention that peroxides, peroxide producing materials, and materials combined with peroxides and peroxide producing materials form a desirable group of structural combination materials for use in the present invention.

Polymers and their associated polymerizers such as acrylic acid, butadiene, cyclopentadiene, ethylene, styrene (vinyl benzene), and vinyl chloride are useful when the exposure to air is controlled for the transition of structural plastics into a nonstructural material that easily crumbles. Several types of reactive plastics are applicable to the present invention. Plastic compositions consisting of ethylene-vinyl and polyvinyl alcohol, and similar compounds are readily reacted from structural materials to nonstructural materials by the action of sunlight and temperature. Cellulose-based resins and combination materials also represent an effective material choice for this invention.

Anyone skilled in the art of reactive plastics can provide a formulation offering the appropriate degree of structural to nonstructural transition depending upon the environmental and performance characteristics desired.

Melting point linkages made of materials such as Wood's metal (melting point 158 degrees F.), Cerrolow 117 (melting point 117 degrees F.) and waxes among other thermally reactive materials are useful in initiating a structural to nonstructural linkage change based on temperature. Landmines set to arm at temperature that are placed in the late winter could deny walking and other routes to an enemy moving in early spring or summer. The expansion of water changing to ice could be useful in initiating a thermally activated state change.

To safeguard against the premature initiation of the reactive process, munitions in storage, transport or those awaiting use in the field should be protected from environmental influences. This is readily and inexpensively addressed by employing enhanced environmental protection in their shipping containers and in the munitions packaging. It is an embodiment of the current invention that the reactive materials are packaged such that their exposure to reactive environmental factors be controlled and exactly known during deployment.

Chemicals such as irritating and inflammatory agents are an integral part of the lance. Agents such as pepper derivates (Oleoresin Capsicum and related compounds), alcohols, ketones, solvents, oils, mustards, halogenated organic compounds, metals, organics, inorganics, minerals, cyanoacrylates, and histamine producing or initiating compounds may be used to increase the discomfort level and encourage the enemy personnel to seek immediate medical attention.

Thermal agents are incorporated that rapidly increase the temperature of the lance, and in this manner will encourage the enemy personnel to immediately cease battle activities. A pyrotechnic whistle or small explosive report are incorporated in the lance penetrator or lance to alert friendly personnel to the proximity of a triggered lance penetrator. By equipping the lance in such a manner and providing an attached notice with instructions as to where and in what time period to seek proper medical attention, the enemy personnel will be highly encouraged to surrender to the designated authorities. Intelligence and other information gathering may be positively augmented in such a manner.

Electrical agents, such as a battery powered device providing electrical shock, or a mechanical vibrator providing mechanical stimulation, may be integrated into the lance penetrator to facilitate inhibitory action against the enemy personnel.

Drugs such as sedatives, tranquilizers or other inhibiting or stimulating medications may be incorporated for lance delivery. In this manner, the enemy personnel are disabled for ready apprehension.

Dyes, drugs or biological agents are introduced that dye the skin of the enemy personnel for ready identification. As these dyeing agents are internal and systemic, they will be impossible to wash off as with externally applied agents. In the case where the penetrator is targeted against enemy personnel wearing shoes or boots, the penetrator may be so contrived as to penetrate the shoe and foot with a final mechanical stop, such as a nail or screw head, or washer, to stop the penetrator from passing completely through the shoe and therefore attaching or fastening the shoe to the foot.

In all the possible applications, incorporations and adaptations of the lance and lance penetrator, it is preferred to selectively have the lance penetrator and lance remain mechanically together as one piece impeding walking, have the lance and lance penetrator separate but attached using chain, wire, rope, fiber, cable, lanyard or other connecting medium to connect the lance to the buried lance, or have the lance penetrator and lance completely separate upon action as desired. The lance and lance penetrator may be comprised of metal, non-metal, plastic, wood, stone, glass, ceramic, chemical agent, combination of chemical agents, or any material with properties sufficient to accomplish the penetration function.

The lance penetrator powers the lance by pyrotechnic propellant, propelling explosive, compressed gas, pyrolytic action, mechanical spring, gas spring, or mechanical action resulting from the pressure exerted by the enemy personnel against the mine. The present invention is electronically equip-able such that it can be remotely disarmed and rearmed as desired.

The lance penetrator is initiated by mechanical or pyrolytic action, or by remote control when so equipped. The lance penetrator is fully electronically equipped for command, condition reporting and control as desired. The lance penetrator may be equipped with electronic proximity fuses for initiation.

The detonator, initiator, firing pin, sharable or breakable component, or other firing mechanism of the present invention may be made pressure sensitive such as to differentiate between the weight of a tank or other vehicle and that of enemy personnel, and made to act only at the weight range of enemy personnel.

It has been proposed to place landmines along border areas to reduce or prevent the crossing of illegal immigrants, drugs, and terrorists. Opponents have indicated that landmines kill or seriously maim, and that such severe injury is unreasonable for this situation. The present invention offers a painful but non-lethal deterrent, and a clear and reliable capability of identifying the injured personnel as illegals.

After military missions or actions have been completed, it is often important to neutralize or deactivate mines in order to ensure that civilian or friendly personnel are not harmed by munitions that have not been activated by enemy forces. It is an object of the present invention that the lance penetrator be equipped to self sterilize and deactivate at a predetermined time by the action of integrated chemical components.

DETAILED DESCRIPTION OF THE PREFERRED EMBODIMENTS

FIG. 1 is a cross sectional view of the present invention with and without a stop plate and the various differences between a spring and a retaining pin regarding initiation thereof.

FIG. 1A is a cross-sectional view of the present invention showing lance 1 with integrated payload 2 such as an RFID in tube 4. It is an embodiment of the present invention that lance 1 be further comprised of an integrated propellant and propellant chamber 3 and propellant 10 and initiator 9. It is an embodiment of the present invention that the propellant chamber 3 be of a diameter to fit tube 4 such that the propellant gasses generated upon initiation by initiator 9 of propellant 10 be contained sufficiently to provide pressure propelling lance 1, and that the lance 1 be the same diameter as the inner diameter of tube 4 or smaller.

The lance 1 may be any cross-sectional shape, including round or square. When the propellant chamber 3 is larger in diameter than the lance 1, then upon firing the propellant force on the surface impacting area 11 of the lance 1 is a multiple of the ratio of the cross-sectional area of the propellant chamber tube 4 divided by the impacting area 11 of the lance 1. When lance 1 is stepped on and moves to the bottom of tube 4, the propellant 10 encounters initiator 9 fires and drives lance 1 out of tube 4. It is an embodiment of the present invention that retaining pin 7 hold lance 1 in place in tube 4. It is a further embodiment of the present invention that retaining pin 7 be selected to release lance 1 after a predetermined level or force has been applied to the head of lance 1, such as by being stepped on. By selecting retaining pin 7 to release lance 1 at a given load, the lance penetrator can be selected to fire only against a target that exerts a sufficient load on the lance mine. It is an embodiment of the present invention that the lance penetrator is selectable to fire only when the force is sufficient to indicate, for example, an adult male insurgent and not fire when stepped on by a child.

FIG. 1B is a cross section of the tube 4 containing the lance 1, tube 4 sealed against the elements by stop plate 5, crush washer 8, washer seal 6 and lance 1. Stop plate 5 has a hole allowing passage of lance 1 sealed by washer seal 6. Stop plate 5 and crush washer 8 are physically connected forming a single operational component allowing stop plate 5 and tube 4 to be connected by crush washer 8. Stop plate 5 is inserted using crush washer 8 into and seals tube 4, and seals against lance 1 with washer seal 6 closing tube 1 against the elements. Stop plate 5 provides surface area to stabilize and hold tube 4 in place in loose soils such as sand.

Spring 13 resists the movement of the lance 1 and in particular the propellant 10 into contact with initiator 9. When sufficient force is applied to lance 1 via surface impacting area 11 to depress spring 13 enough to allow the contact of propellant 10 with initiator 9, propellant 10 initiates and the gasses produced are contained by the contact of propellant chamber 3 and tube 1 allowing the generation of pressure and the propelling of lance 1 through tube 4. Spring 13 may be to one side as shown or around initiator 9, and is preferred in any position suitable to the selected design. Spring 13 may be metal or plastic, and is preferred to be a compressive material evenly distributing the mechanical compressive load of propellant chamber 3. In this manner side loading of propellant chamber 3 and tube 4 are minimized and mechanical binding or sticking is minimized.

Crush washer 8 is caught by lance shoulder 12 upon lance 1 initiating and being propelled in tube 4. Crush washer 8 deforms when impacted by lance 1 and exits tube 4 being caught between lance shoulder 12 and stop plate 5. Stop plate 5 is carried with lance 1 into the target, such as a boot that has stepped on the lance mine, and provides surface area to spread the impact force and prevent further penetration of lance 1. The lance tube 4 and the lance 1 with the stop plate 5 are separated with the tube 1 remaining in the ground. Optionally these components can remain together by crush washer 8 being selected to maintain connection between tube 4 and lance 1. In any of these scenarios, the boot and foot are fastened together with a deep puncture wound in the insurgent's foot disabling the insurgent.

Figures 2, 2A, 2B:
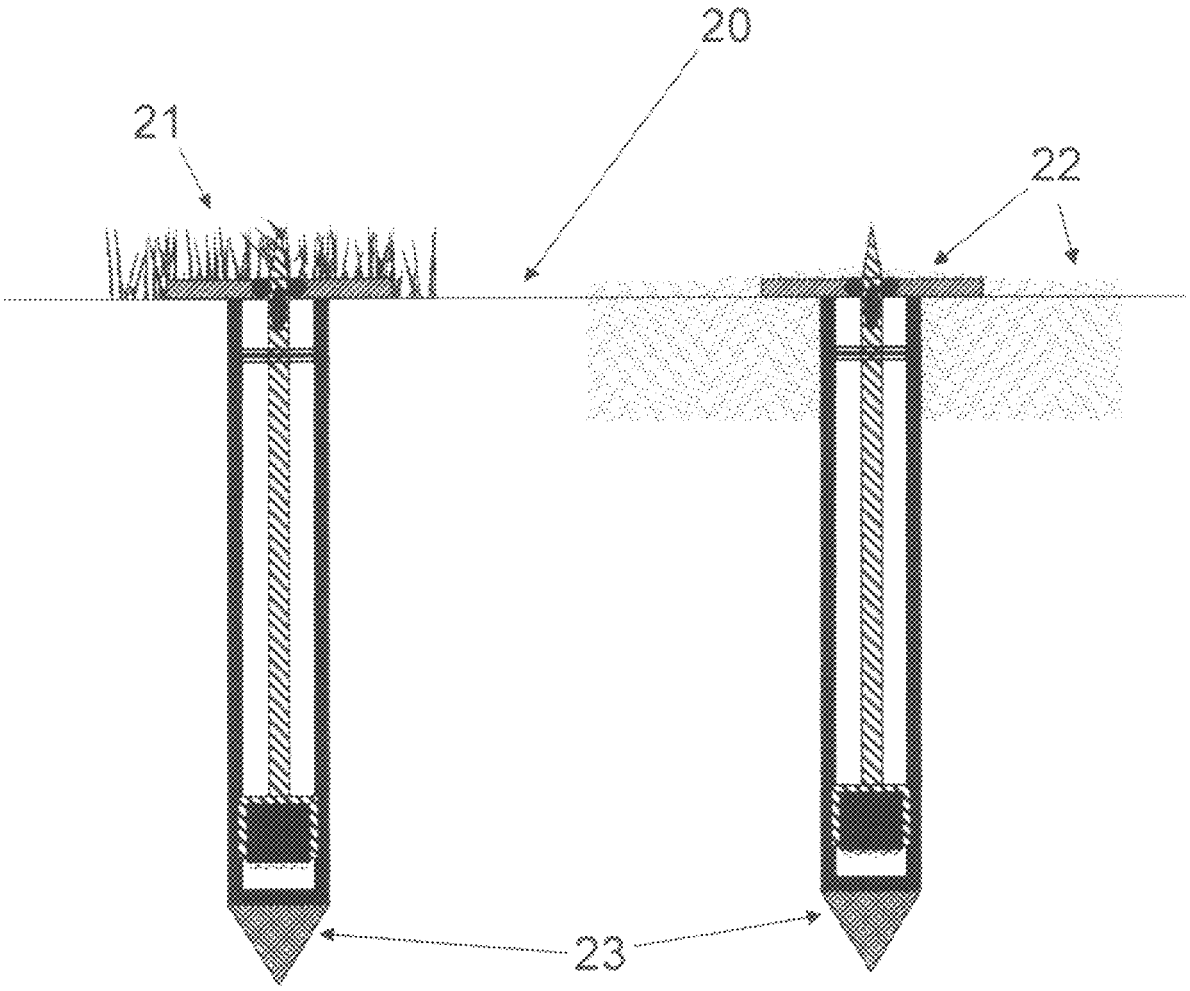
FIG. 2 shows lance mine and spike penetrator with pickup washer, ground penetrator means and self-camouflaging means in a sand and a grassy environment.

FIG. 2 shows two lance penetrators in cross section mounted at ground level. The protruding section of the lance penetrator at or above ground level 20 is made self camouflaging by coating with a sticky substance such as an adhesive. This provides means for the ground material such as sand, soil, grass or leaves to be blown or otherwise come in contact with the adhesive and stick to the lance mine, effectively camouflaging the lance, and providing means facilitating the lance to be readily camouflaged in any environment. Adhesives of any type may be used including pressure-sensitive adhesives such as acrylate copolymers and contact cements. Water and sun resistant adhesives are preferred.

FIG. 2A shows the lance penetrator in a grassy environment 21 with grasses and other native material sticking to and camouflaging the lance mine.

FIG. 2B shows the lance penetrator in sand 22 with the sand sticking to the exposed parts of the lance penetrator rendering it camouflaged. Ground spikes 23 facilitate easy ground penetration.

Figure 3:
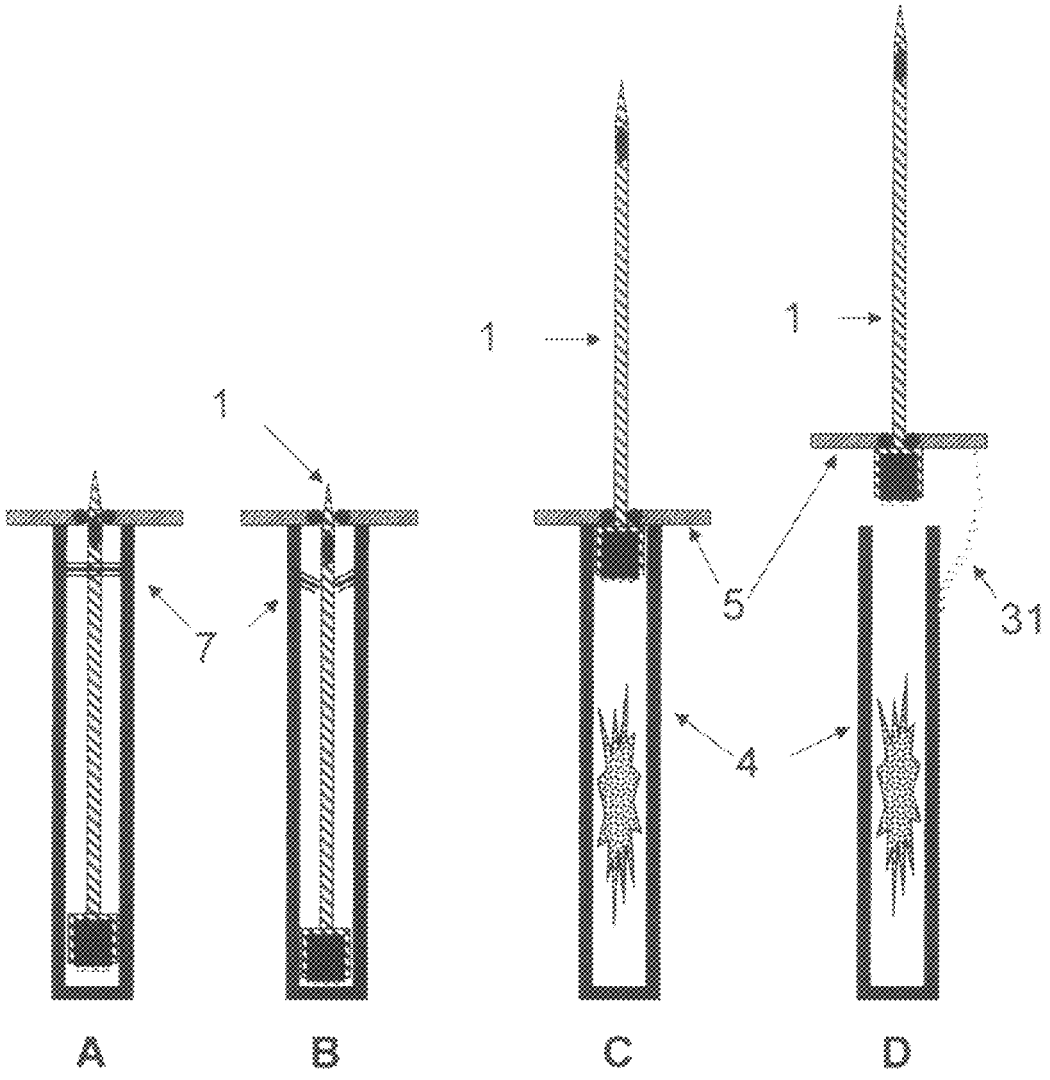
FIG. 3 shows the firing sequence and firing possibilities for the lance mine.

FIG. 3 shows the firing sequence and possibilities for the lance mine. In FIG. A the lance penetrator is in an armed and stable condition. In FIG. B when pressure is applied by stepping on or otherwise contacting the lance mine, the lance 1 is forced down and the retaining pin 7 is yielded, allowing the lance to fire. In FIG. C the fired lance 1 moves out of the tube 4 and penetrates the target. In this case the pickup washer 5 contains the lance 1 keeping the lance, now embedded in the target, and the lance penetrator together impeding the target's ability to move. In FIG. D the fired lance 1 moves out of the tube 4 and penetrates the target. In this case the pickup washer 5 separates from the tube 4 and continues with the lance 1 that is now embedded in the target. Optionally the lance can be tethered to the lance penetrator by tether 31 to further impede the mobility of the target.

Figure 4:
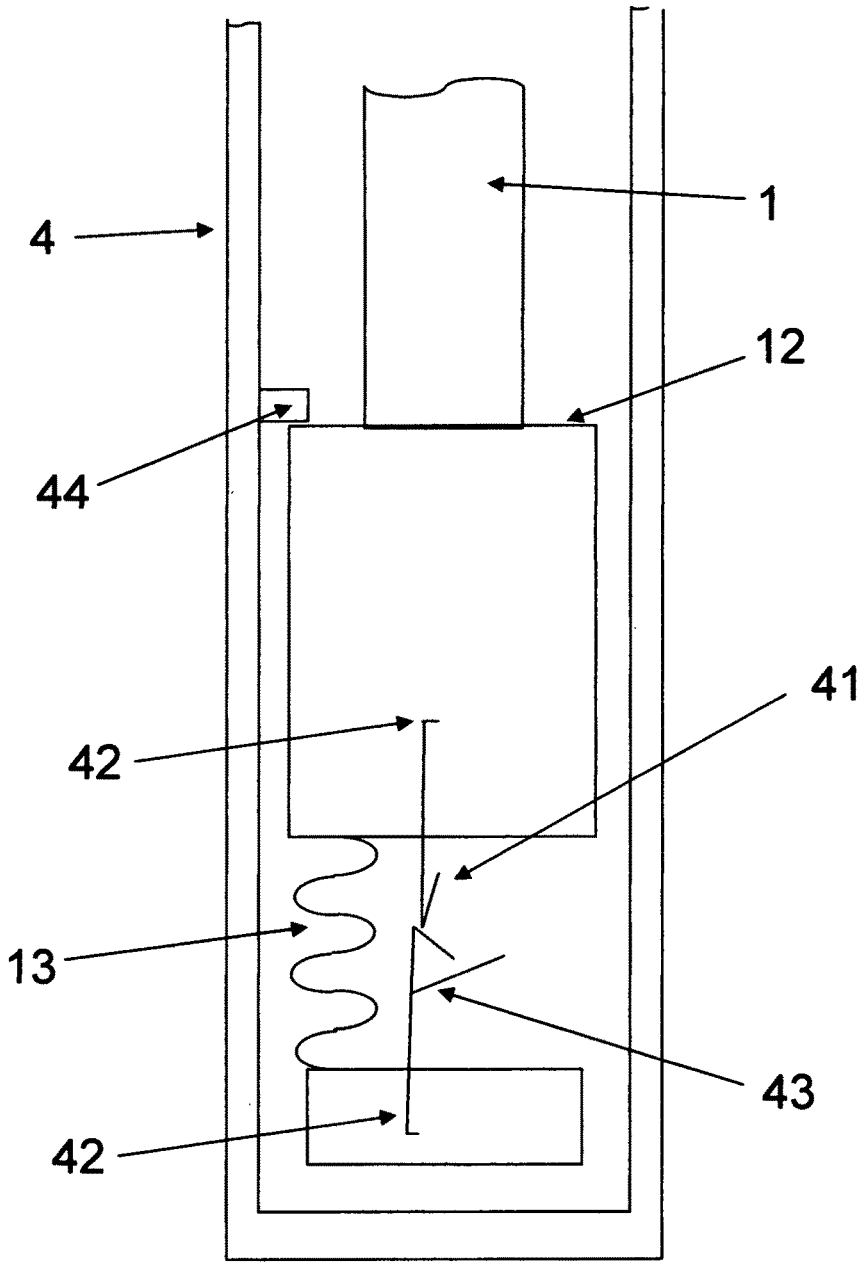
FIG. 4 reveals the method for a lance penetrator selectively firing within a pressure applied range.

FIG. 4 reveals the method for a lance penetrator selectively firing within a pressure applied range. Lance 1, tube 4, lance shoulder 12, spring 13, top firing catch hook 41, firing catches 42, bottom firing catch hook 43 and lance shoulder retainer 44 are shown.

Lance 1 is environmentally contained in tube 4. Lance shoulder 12 engages with lance shoulder retainer 44 preventing the lance 1 from readily being pulled from the tube 4. Spring 13 is a compression spring and holds pressure against lance 1 holding it away from the penetrator end ground spike 23 (not shown) end of tube 4. Top firing catch hook 41 is a selectively flexible or rigid member formed as a hook. It is alternatively configurable to ignite a propellant action upon extraction. Firing catches 42 are configured to initiate a propellant upon extraction. Top or bottom or both areas may initiate as desired. The propellant action generates gas propelling the lance 1 from tube 4. Bottom firing catch hook 43 is configured to facilitate lance actions on overpressure, underpresurre and within fire range pressure.

Figure 5:
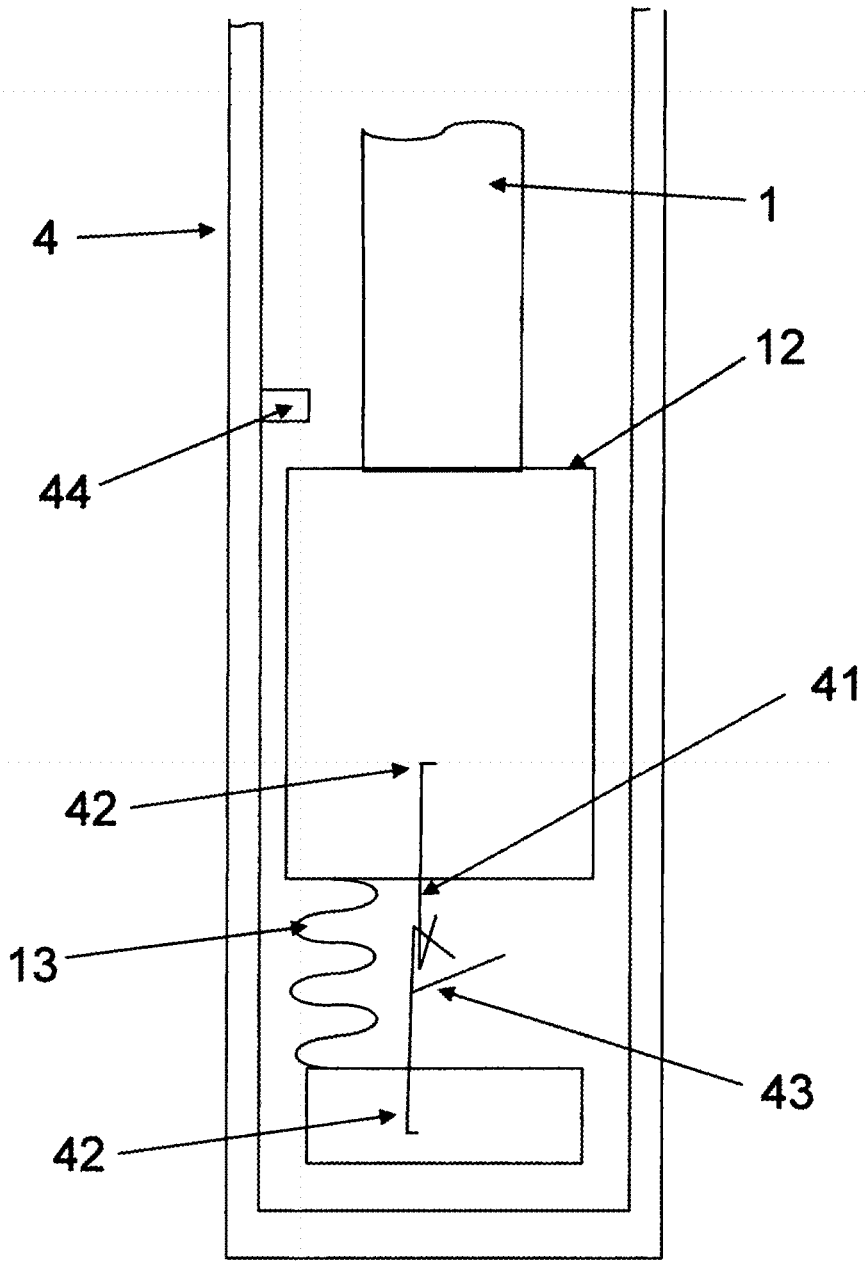
FIG. 5 reveals the method for a lance penetrator selectively firing within a pressure applied range as the lance is pressed by an insurgent stepping on the lance.

FIG. 5 reveals the method for a lance penetrator selectively firing within a pressure applied range as the lance 1 is pressed as by an insurgent stepping on the lance. Lance 1, tube 4, lance shoulder 12, spring 13, top firing catch hook 41, firing catches 42, bottom firing catch hook 43 and lance shoulder retainer 44 are shown.

Lance 1 is pressed "down" in the direction of the ground spike 23 (not shown) in tube 4. Lance shoulder 12 is no longer in contact with lance shoulder retainer 44. Spring 13 is compressed and top firing catch hook 41 and bottom firing catch hook 43 are snapped over each other such that they will apply tension to each other should the lance 1 return to its rest position as in FIG. 4.

Figure 6:
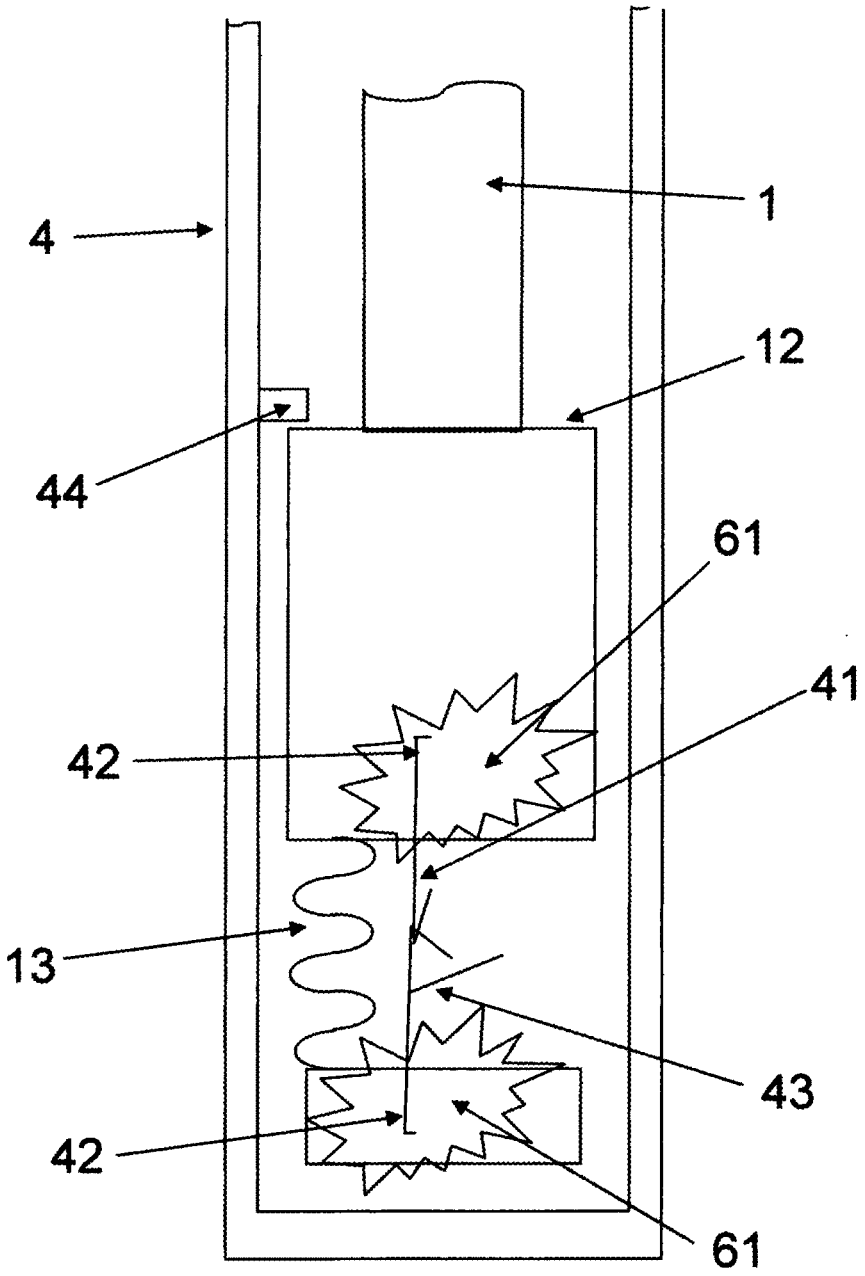
FIG. 6 further reveals the method for a lance penetrator selectively firing within a pressure applied range as the lance is pressed by an insurgent stepping on the lance.

FIG. 6 further reveals the method for a lance penetrator selectively firing within a pressure applied range as the lance 1 is pressed as by an insurgent stepping on the lance. Lance 1, tube 4, lance shoulder 12, spring 13, top firing catch hook 41, firing catches 42, bottom firing catch hook 43 and lance shoulder retainer 44 are shown.

Lance 1 previously pressed "down" in FIG. 5 now moves towards the "top" as the insurgent relieves pressure on the lance 1 (above ground side, not shown) moved by spring 13 forcing the lance 1 up towards it's rest position against the lance shoulder retainer 44. The now hooked together top firing catch hook 41 and bottom firing catch hook 43 are placed in tension by the action of spring 13 and initiate pyrotechnic action 61, either within the lance 1 or in the tube 4 or both as desired. Initiating from both the tension of 41 and 43 assurers pyrotechnic action 61.

Figure 7:
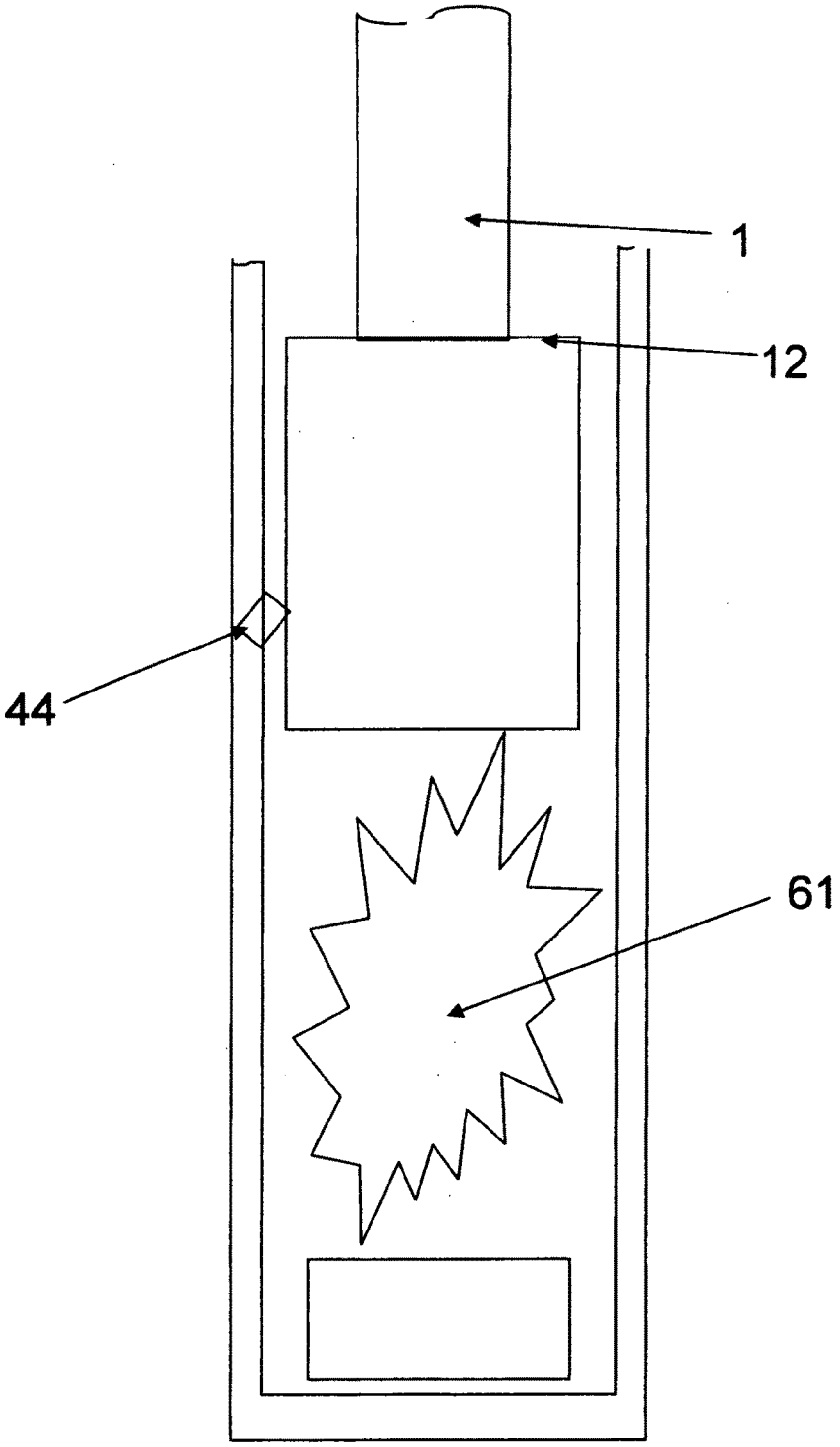
FIG. 7 shows the pyrotechnic action propelling the lance and lance shoulder breaking lance shoulder retainer.

FIG. 7 shows the pyrotechnic action 61 propelling lance 1 and lance shoulder 12 breaking lance shoulder retainer 44. In this manner the lance penetrator is initiated and the insurgent is incapacitated. Operating time for this action is dependent on the propellant chemistries selected.

Figure 8:
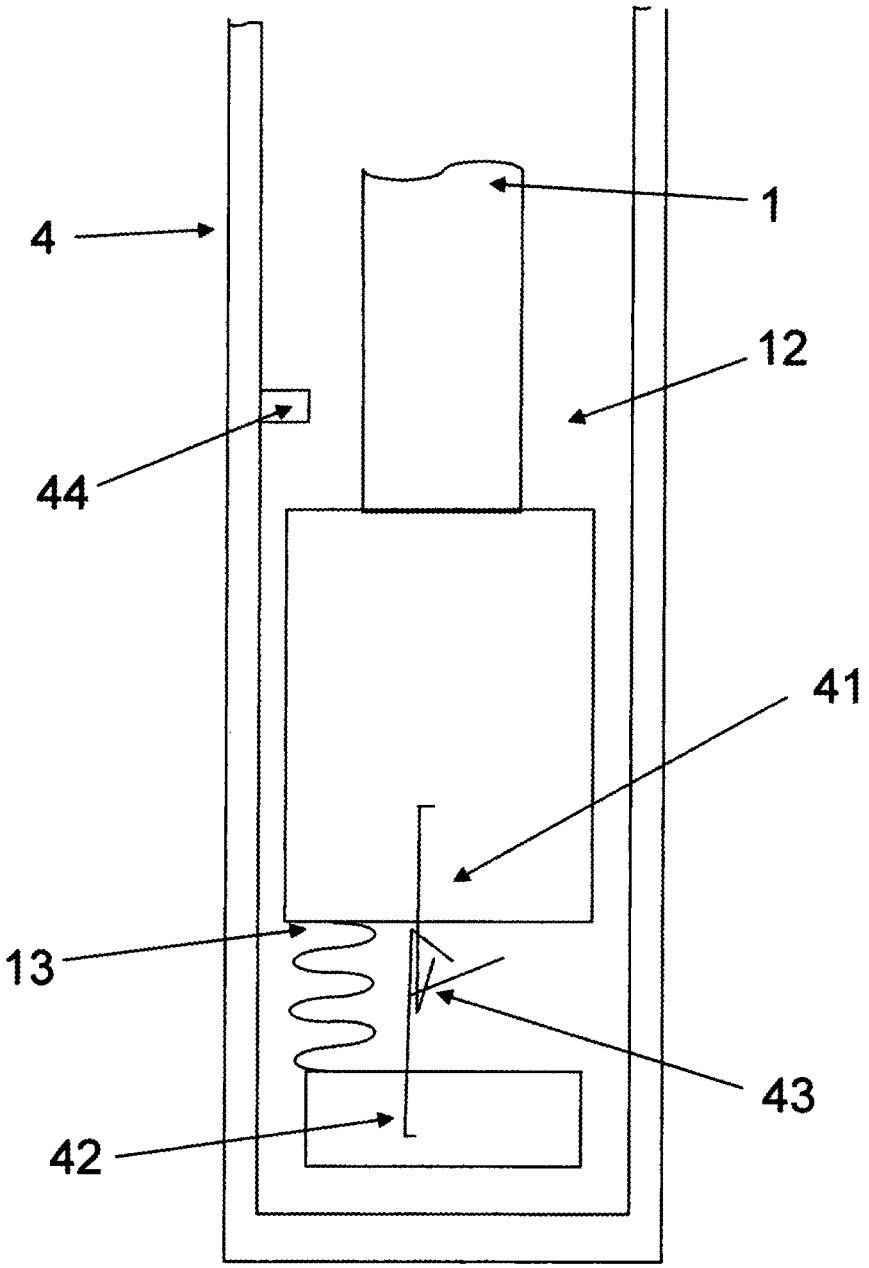
FIG. 8 demonstrates the recovery action of the present invention when it is overpressed.

FIG. 8 demonstrates the recovery action of the present invention when it is overpressed. This condition occurs when the lance 1 is fully compressed into the tube 4 as might be the case when run over by a tank.

Lance 1 is pressed "down" in the direction of the ground spike 23 (not shown) in tube 4. Lance shoulder 12 is no longer in contact with lance shoulder retainer 44. Spring 13 is compressed and top firing catch hook 41 and bottom firing catch hook 43 are snapped beyond each other such that they will be diverted over each other should the lance 1 return to it's rest position as in FIG. 4.

Figure 9:
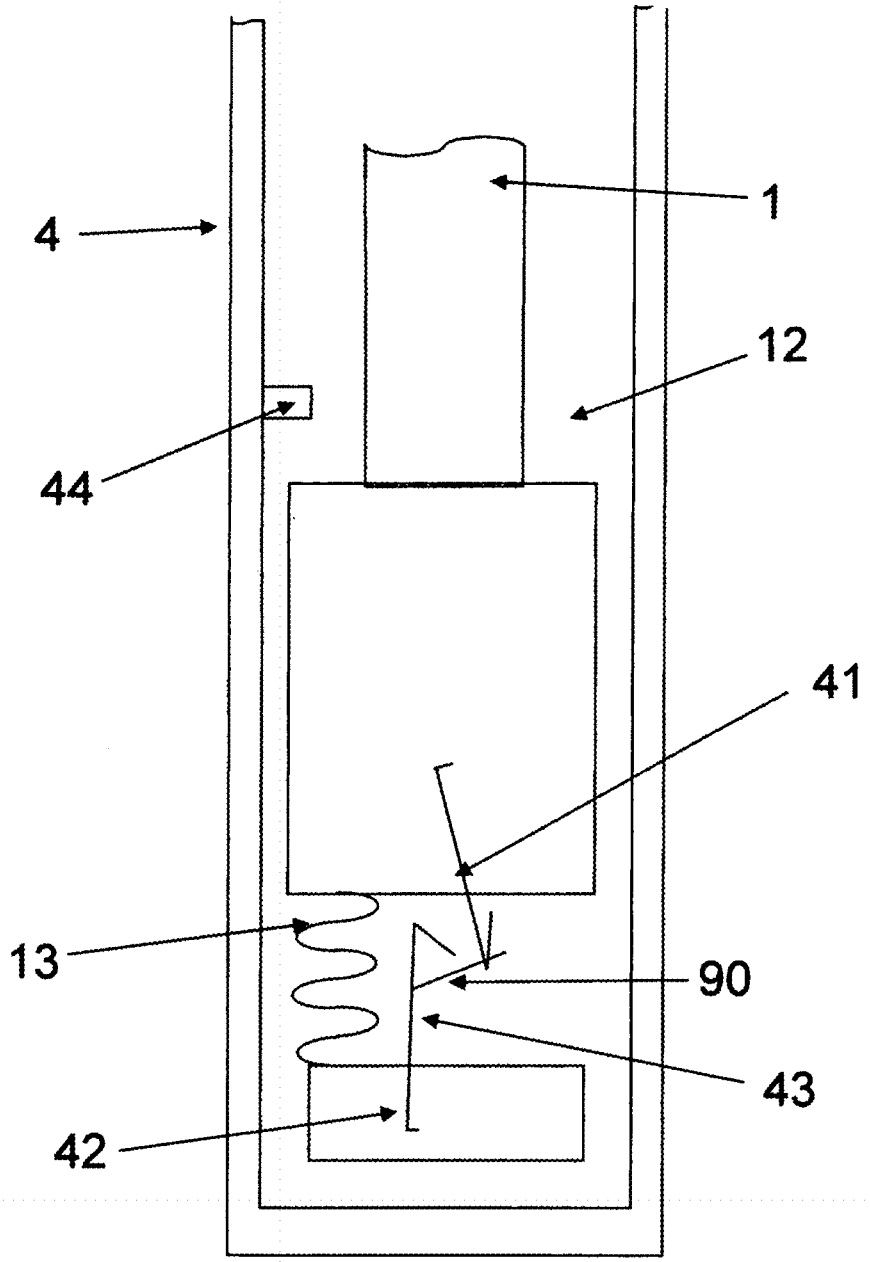
FIG. 9 further demonstrates the recovery action of the present invention when it is overpressed.

FIG. 9 further demonstrates the recovery action of the present invention when it is overpressed. This condition occurs when the lance 1 is fully compressed into the tube 4 as might be the case when run over by a tank.

Lance 1 is pressed "down" in the direction of the ground spike 23 (not shown) in tube 4. Lance shoulder 12 is no longer in contact with lance shoulder retainer 44. Spring 13 is compressed and top firing catch hook 41 and bottom firing catch hook 43 are snapped beyond each other such that they will be diverted over each other should the lance 1 return to it's rest position as in FIG. 4. They are diverted by top firing catch hook 41 flexing and being drawn around bottom firing catch hook 43 by bottom firing catch hook 43 bypass bar 90. Both top firing catch hook 41 and bottom firing catch hook 43 are preferred to be flexible or rigid as desired to facilitate this action.

Figure 10:
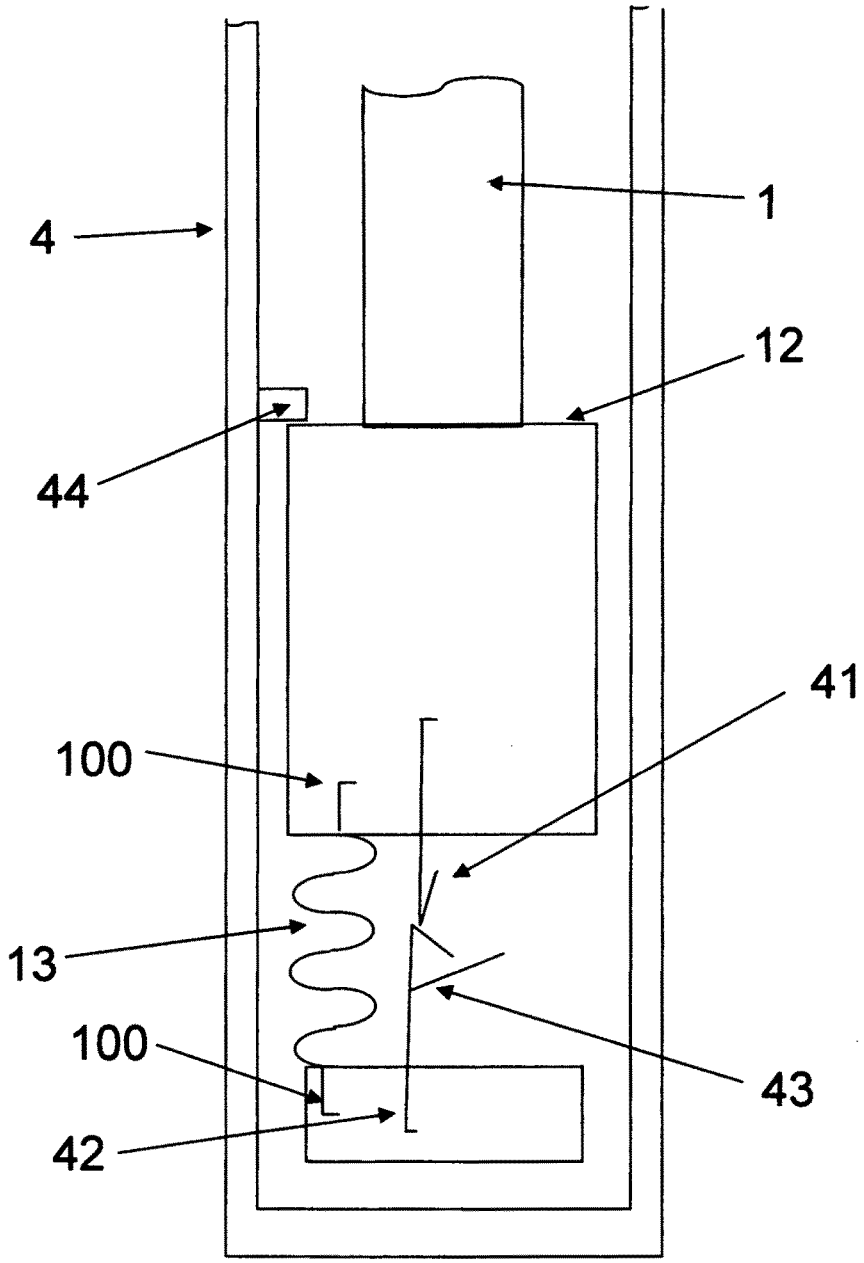
FIG. 10 shows the lance penetrator fully returned to the armed and ready position.

FIG. 10 shows the lance penetrator fully returned to the armed and ready position resting against lance shoulder retainer 44. Spring 13 is shown optionally equipped with pullout retainers 100. If the lance 1 is pulled overcoming lance shoulder retainer 44 then pullout retainers 100 initiate pyrotechnic action 61 (see FIG. 6). In this manner the area denial device cannot be disarmed by an enemy without initiating the lance.

Figure 11:
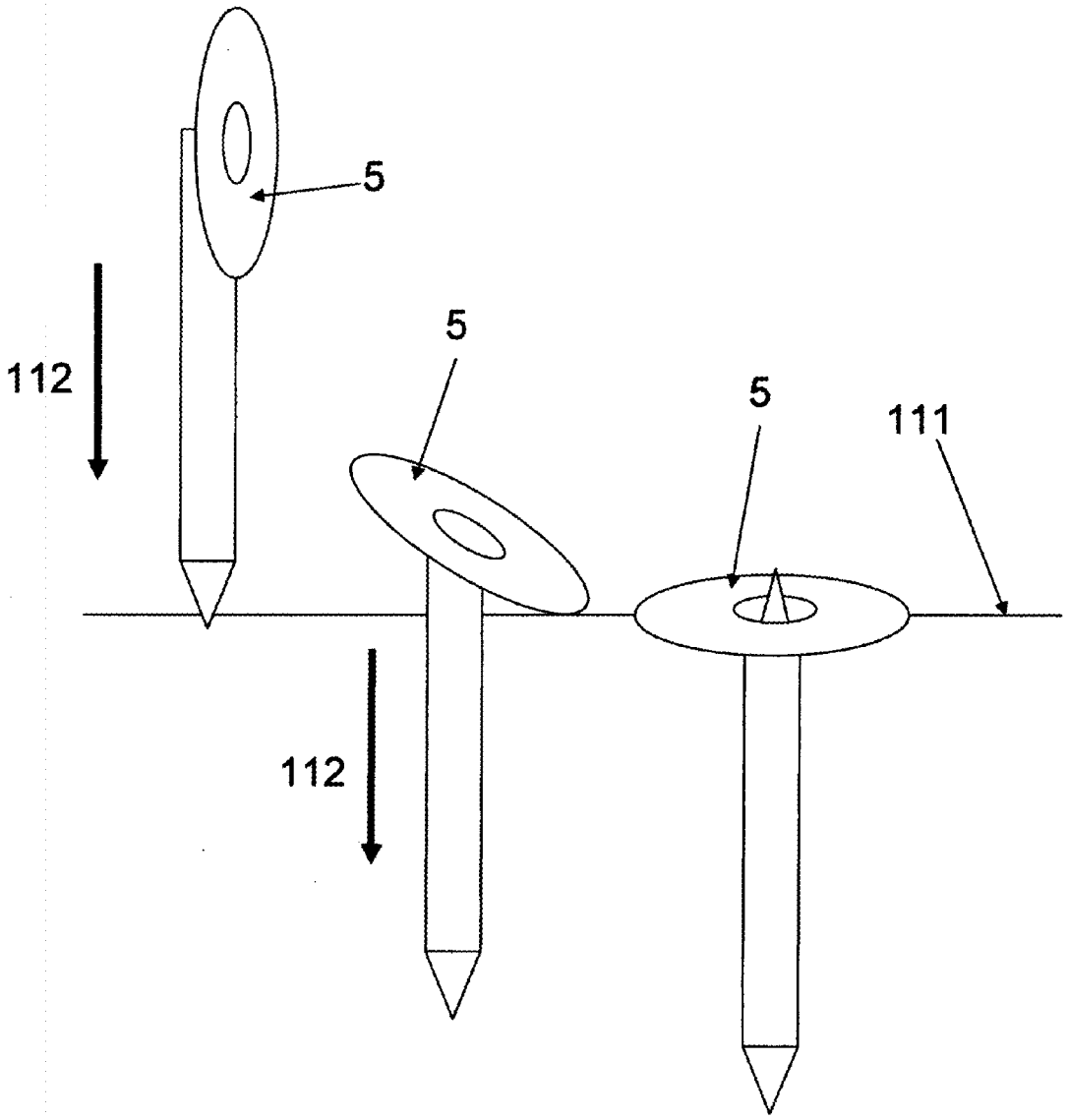
FIG. 11 shows the area denial device being deployed either by air drop or manually with the stop plate hinged facilitating aerodynamic stability and a more compact stacking of the present invention.

FIG. 11 shows the lance penetrator being deployed either by air drop or manually with the stop plate 5 hinged facilitating aerodynamic stability and a more compact stacking of the present invention. As the lance penetrator intersects and penetrates the ground 111, the stop plate 5 rotates on its hinge due to ground 111 interaction stopping further ground penetration and assuming an operable orientation. Arrow 112 indicates the direction of motion.

Figure 12:
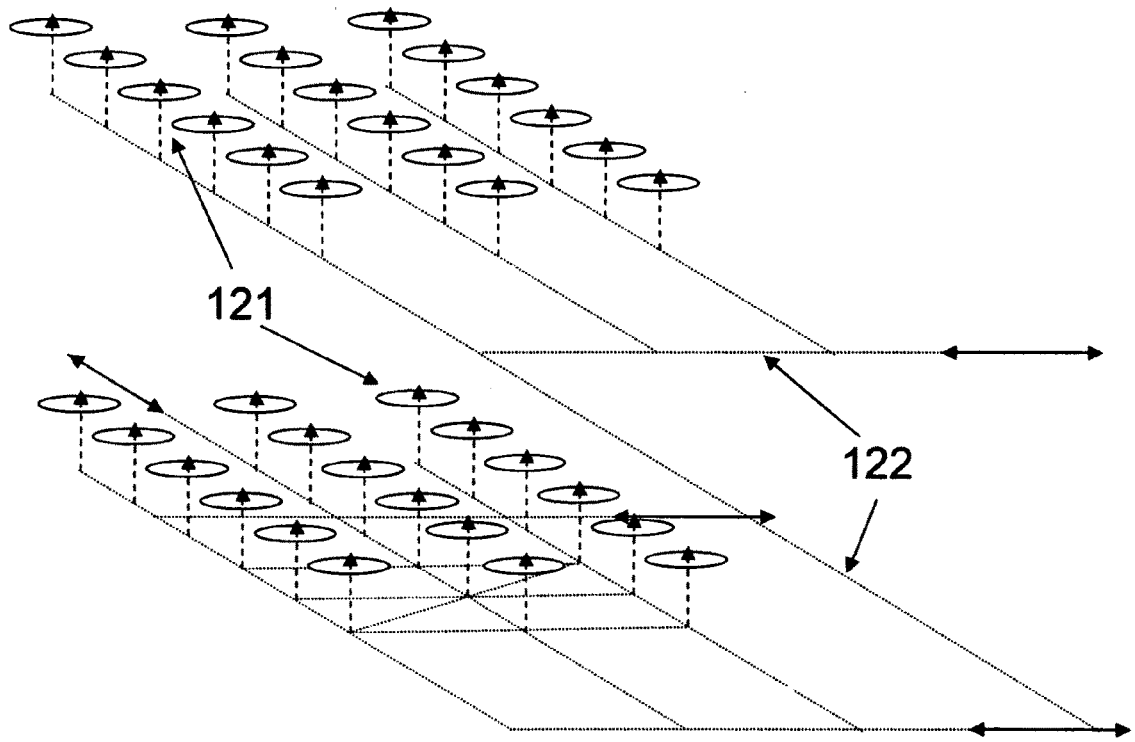
FIG. 12 shows an array of deployed and electrically interconnected area denial devices.

FIG. 12 shows an array of area denial devices 121 connected by power and/or control cabling and/or wiring 122.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art, and should not be interpreted in an idealized or overly formal sense unless expressly so defined herein. Well-known functions or constructions may not be described in detail for brevity and/or clarity. Terms such as soldier, insurgent or enemy are used in context and interchangeably to better convey understanding of the context.

While the present invention has been described in terms of various specific embodiments, those skilled in the art will recognize that the invention can be practiced with considerable modification within the spirit and scope of the following claims.

We claim:

1. A method of using an area denial device comprising:

a) providing an area denial device including a tube with a closed end and an open end, a stop plate attached to the tube with a hinge at the open end, a lance penetrator comprising a propellant chamber contained within the tube, an initiator positioned on an interior surface of the closed end of the tube, propellant contained within the propellant chamber, and a spring positioned within the tube and between the propellant and the closed end;

b) rotating the stop plate about the hinge to an orientation substantially parallel with a longitudinal axis of the tube;

c) dropping the area denial device from a flying aircraft toward a ground, whereby the area denial device penetrates the ground upon impact and the stop plate rotates to an orientation substantially perpendicular to the longitudinal axis of the tube thereby placing the area denial device into a deployed configuration, a tip of the lance penetrator protruding from a hole in the stop plate in the deployed configuration;

d) depressing the tip of the lance penetrator whereby the lance penetrator is moved toward the initiator at the closed end of the tube thereby compressing the spring, the initiator igniting the propellant upon contacting the propellant, the ignition driving the lance penetrator out of the open end of the tube and into an outside object.

2. A method of initiating an area denial device comprising:

a) providing an area denial device including a tube with a closed end and an open end, a lance penetrator comprising a propellant chamber and a top firing catch hook contained within the tube, an initiator positioned on an interior surface of the closed end of the tube, a bottom firing catch hook comprising a bypass bar positioned adjacent the initiator, propellant contained within the propellant chamber, and a spring positioned within the tube and between the propellant and the closed end; and b) depressing the lance penetrator towards the initiator at the closed end of the tube to compress the spring a first distance whereby the top firing catch hook and bottom firing catch hook do not pass each other, releasing the lance penetrator whereby the spring decompresses and the lance penetrator moves towards the open end of the tube returning the area denial device to an armed and stable configuration; and c) depressing the lance penetrator towards the initiator at the closed end of the tube to compress the spring a second distance whereby the top firing catch hook and bottom firing catch hook travel past each other and whereby the top firing catch hook travels past the bypass bar, releasing the lance penetrator so that the spring decompresses and the lance penetrator moves towards the open end of the tube whereby the top firing catch hook engages the bypass bar and bypasses the bottom firing catch hook and the area denial device is returned to the armed and stable configuration; and d) depressing the lance penetrator towards the initiator at the closed end of the tube to compress the spring a third distance whereby the top firing catch hook and bottom firing catch hook travel past each other, releasing the lance penetrator so that the spring decompresses and the lance penetrator moves towards the open end of the tube whereby the top firing catch hook engages the bottom firing catch hook thereby placing the top firing catch hook and bottom firing catch hook in tension by action of the spring, the tension igniting the propellant and the ignition driving the lance penetrator out of the open end of the tube and into an outside object.

* * * * *